US009366087B2

(12) United States Patent
Sugiura et al.

(10) Patent No.: US 9,366,087 B2
(45) Date of Patent: Jun. 14, 2016

(54) HIGH DOGLEG STEERABLE TOOL

(71) Applicant: Schlumberger Technology Corporation, Sugar Land, TX (US)

(72) Inventors: Junichi Sugiura, Bristol (GB); Geoffrey C. Downton, Stroud (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 372 days.

(21) Appl. No.: 13/753,483

(22) Filed: Jan. 29, 2013

(65) Prior Publication Data

US 2014/0209389 A1 Jul. 31, 2014

(51) Int. Cl.

| | |
|---|---|
| ***E21B 7/06*** | (2006.01) |
| ***E21B 17/05*** | (2006.01) |
| *E21B 17/10* | (2006.01) |

(52) U.S. Cl.

CPC ..... *E21B 7/067* (2013.01); *E21B 7/062* (2013.01); *E21B 7/068* (2013.01); *E21B 17/05* (2013.01); *E21B 17/1014* (2013.01)

(58) Field of Classification Search

CPC ..... E21B 7/067; E21B 7/068; E21B 7/062; E21B 17/05

See application file for complete search history.

(56) References Cited

U.S. PATENT DOCUMENTS

| | | | | |
|---|---|---|---|---|
| 2,177,738 | A | | 7/1938 | Nolan |
| 2,172,325 | A | | 9/1939 | Victor et al. |
| 2,282,165 | A | | 5/1940 | Corson |
| 3,667,556 | A | * | 6/1972 | Henderson ..... 175/73 |
| 4,732,223 | A | * | 3/1988 | Schoeffler et al. ..... 175/73 |
| 4,895,214 | A | | 1/1990 | Schoeffler |
| 5,048,622 | A | | 9/1991 | Ide |
| 5,113,953 | A | | 5/1992 | Noble |
| 5,135,060 | A | | 8/1992 | Ide |
| 5,265,682 | A | | 11/1993 | Russell et al. |
| 5,305,838 | A | * | 4/1994 | Pauc ..... 175/73 |
| 5,307,885 | A | | 5/1994 | Kuwana et al. |
| 5,353,884 | A | | 10/1994 | Misawa et al. |
| 5,542,482 | A | | 8/1996 | Eddison |
| 5,603,386 | A | | 2/1997 | Webster |

(Continued)

FOREIGN PATENT DOCUMENTS

| | | |
|---|---|---|
| EP | 1024245 | 10/2004 |
| EP | 1355073 | 3/2005 |

(Continued)

OTHER PUBLICATIONS

International search report and written opinion for the equivalent PCT patent application No. PCT/US2013/070672 issued on Feb. 27, 2014.

*Primary Examiner* — Jennifer H Gay

(57) ABSTRACT

A rotary steerable drilling system may include a substantially non-rotating tool body, a rotatable shaft including at least one pivotable feature, where the rotatable shaft is at least partially disposed within the tool body, and a bias unit that alters the position of the rotatable shaft within the tool body. The rotary steerable drilling system may also include at least one force application member that alters the position of the tool body in the borehole. A downhole steering motor may include a rotor shaft with at least one pivotable joint, a steering motor housing, a bias unit that alters the position of the rotor shaft inside the steering motor housing, and at least one force application member that alters the position of the steering motor housing in a borehole.

8 Claims, 7 Drawing Sheets

(56) References Cited

U.S. PATENT DOCUMENTS

| | | | | |
|---|---|---|---|---|
| 6,092,610 | A | 7/2000 | Kosmala et al. | |
| 6,109,372 | A | 8/2000 | Dorel et al. | |
| 6,290,003 | B1 | 9/2001 | Russell | |
| 6,364,034 | B1 * | 4/2002 | Schoeffler | 175/38 |
| 6,427,783 | B2 | 8/2002 | Krueger et al. | |
| 6,598,687 | B2 * | 7/2003 | Eppink et al. | 175/73 |
| 6,808,027 | B2 | 10/2004 | McLoughlin et al. | |
| 6,837,315 | B2 | 1/2005 | Pisoni et al. | |
| 7,383,897 | B2 | 6/2008 | Moody et al. | |
| 9,038,750 | B2 * | 5/2015 | Abbasi | 175/320 |
| 2001/0052427 | A1 * | 12/2001 | Eppink et al. | 175/40 |
| 2002/0129945 | A1 | 9/2002 | Brewer et al. | |
| 2009/0166089 | A1 | 7/2009 | Millet | |
| 2013/0319764 | A1 * | 12/2013 | Schaaf et al. | 175/24 |
| 2014/0209389 | A1 * | 7/2014 | Sugiura et al. | 175/73 |

FOREIGN PATENT DOCUMENTS

| | | | |
|---|---|---|---|
| GB | 2172325 | A | 9/1986 |
| GB | 2177738 | A | 1/1987 |
| GB | 2282165 | A | 3/1995 |
| WO | 96/30616 | | 10/1996 |
| WO | 03/097989 | | 11/2003 |

* cited by examiner

HIGH DOGLEG STEERABLE TOOL

CROSS-REFERENCE TO RELATED APPLICATION

Not applicable.

BACKGROUND

Rotary steerable drilling systems are used in many types of drilling applications to control the direction of drilling. Directional control has become increasingly more prevalent during drilling of subterranean oil and gas wells, for example, to more fully exploit hydrocarbon reservoirs. In some cases, rotary steerable drilling systems are used to drill wells with horizontal and deviated profiles.

To drill directional boreholes into subterranean formations, operators generally employ a bottom hole assembly (BHA) connected to the end of a tubular drill string, which is rotatably driven by a drilling rig from the surface. The drilling rig provides the motive force for rotating the drill string and also supplies a drilling fluid under pressure through the tubular drill string to the BHA. To achieve directional control during drilling, the BHA may include one or more drill collars, one or more stabilizers and a rotary steerable drilling system positioned above the drill bit, which is the lowermost component of the BHA. The rotary steerable drilling system generally includes a steering section and an electronics section and other devices to control the rotary steerable drilling system.

Rotary steerable drilling systems are often classified as either "point-the-bit" or "push-the-bit" systems. In point-the-bit systems, the rotational axis of the drill bit is deviated from the longitudinal axis of the drill string generally in the direction of the new hole. The new hole is propagated in accordance with a three-point geometry defined by upper and lower stabilizer touch points and the drill bit. The angle of deviation of the drill bit axis, coupled with a finite distance between the drill bit and the lower stabilizer, results in a non-collinear condition that generates a curved hole. There are many ways in which this non-collinear condition may be achieved, including a fixed bend at a point in the BHA close to the lower stabilizer or a flexure of the drill bit drive shaft distributed between the upper and lower stabilizer.

In push-the-bit systems, typically no mechanism deviates the drill bit axis from the longitudinal axis of the drill string. Instead, the non-collinear condition is achieved by causing either or both of the upper and lower stabilizers, for example via pads or pistons, to apply an eccentric force or displacement to the BHA to move the drill bit in the desired path. Steering is achieved by creating a non-collinear condition between the drill bit and at least two other touch points, such as the upper and lower stabilizers, for example.

Despite such distinctions between point-the-bit and push-the-bit systems, an analysis of their hole propagation properties reveals that facets of both types of systems are present during operation of each type of rotary steerable drilling system. More recently, hybrid rotary steerable drilling systems have been introduced that intentionally combine the structure and functionality of both the classical point-the-bit system and the classical push-the-bit system into a single system by design rather than circumstance.

SUMMARY

In general, embodiments of the present disclosure generally provide rotary steerable drilling systems for high dogleg severity applications. A rotary steerable drilling system according to the present disclosure may comprise a substantially non-rotating tool body, a rotatable shaft including at least one pivotable feature, where the rotatable shaft is at least partially disposed within the tool body, and a bias unit that alters the position of the rotatable shaft within the tool body. The rotary steerable drilling system may further include at least one force application member that alters the position of the tool body in the borehole. A downhole steering motor according to the present disclosure may comprise a rotor shaft including at least one pivotable joint, a steering motor housing, a bias unit that alters the position of the rotor shaft inside the steering motor housing, and at least one force application member that alters the position of the steering motor housing in a borehole.

BRIEF DESCRIPTION OF THE DRAWINGS

Certain embodiments of the disclosure will hereafter be described with reference to the accompanying drawings, wherein like reference numerals denote like elements, and.

DETAILED DESCRIPTION

Figure 1:
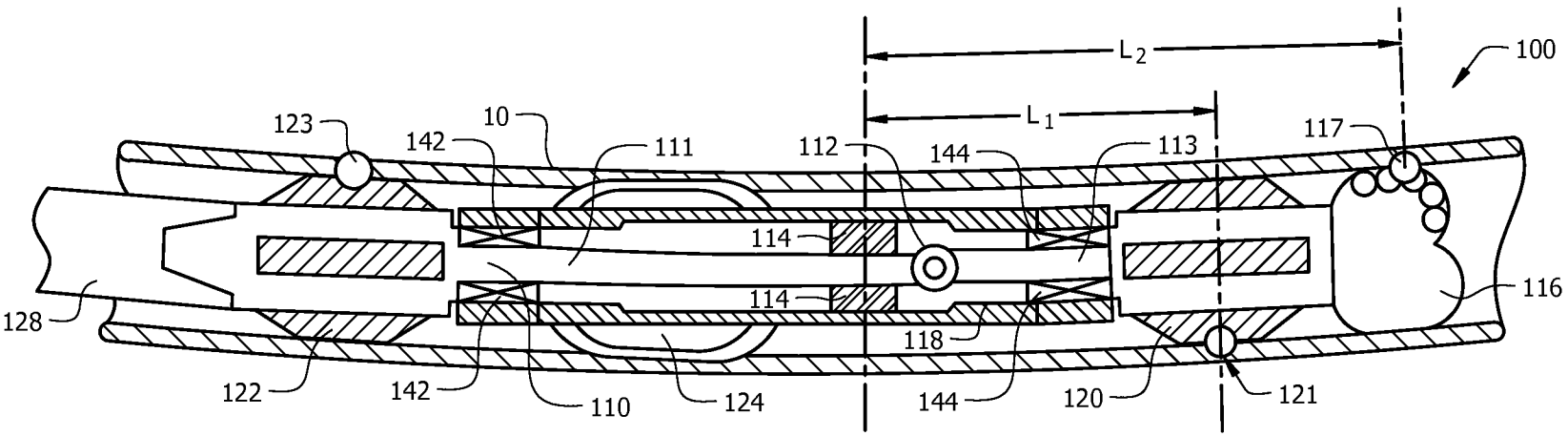
FIG. 1 is an illustration of a point-the-bit rotary steerable drilling system having a substantially non-rotating tool body, a rotatable shaft with a pivotable feature, and an internal bias unit, according to one or more aspects of the present disclosure.

The following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

In the following description, numerous details are set forth to provide an understanding of the present disclosure. However, it will be understood by those of ordinary skill in the art that the present disclosure may be practiced without these details and that numerous variations or modifications from the described embodiments may be possible.

The present disclosure generally relates to oilfield downhole tools and more particularly to rotary steerable drilling systems for high dogleg severity applications. As horizontal and deviated profile wells become more prevalent, rotary steerable drilling systems provide a cost effective, efficient and reliable means for drilling such horizontal and deviated wells. Some types of rotary steerable drilling systems steer the drill bit by engaging the borehole wall at three touch points. In one embodiment of a conventional point-the-bit rotary steerable drilling system, the first touch point is located on the drill bit; the second touch point is located on a near-bit, near-full-gauge stabilizer; and the third touch point is located on a string stabilizer positioned above the rotary steerable drilling system. To maintain appropriate stress and bending moments of the rotatable shaft that drives the drill bit, a distance of at least "L1" must be provided between the internal bias unit (that functions to alter the position of the rotatable shaft) and the next closest touch point toward the bit (i.e. the second touch point on the near-bit stabilizer). Further, a distance of at least "L2" must be provided between the internal bias unit and the first touch point on the drill bit. However, these distances "L1" and "L2" are limiting factors on the build rate that the rotary steerable drilling system is capable of achieving. Conventional rotary steerable drilling systems are designed to achieve build rates of approximately 5 to 8 degree per 100 feet. However, many horizontal wells drilled today require build rates of approximately 10 to 15 degree per 100 feet.

The present disclosure presents several embodiments of rotary steerable drilling systems capable of achieving build rates of approximately 12 to 20 degrees per 100 feet, i.e. high dogleg severity applications. Various embodiments of the rotary steerable drilling system may comprise a rotatable shaft with at least one pivotable feature, such as a universal joint, a constant-velocity joint, a knuckle joint, a spline joint, or a flexible section, for example, disposed within a substantially non-rotating tool body. In an embodiment, the rotary steerable drilling system may further comprise an internal bias unit that alters the position of the rotatable shaft within the tool body and thereby provides point-the-bit steering capability. In an embodiment, the rotary steerable drilling system may further comprise at least one force application member that engages the borehole wall to move the drill bit in the desired direction and thereby provides push-the-bit steering capability. In an embodiment, a hybrid rotary steerable drilling system may include both point-the-bit and push-the-bit steering features.

Referring generally to FIG. 1, an embodiment of a point-the-bit rotary steerable drilling system 100 is shown disposed within a wellbore 10. The drilling system 100 comprises a rotatable shaft 110 with at least one pivotable feature 112 disposed within a substantially non-rotating tool body 118, which may optionally comprise an anti-rotation device 124. At least one of an upper pivot structure 142 and a lower pivot structure 144 is provided between the rotatable shaft 110 and the tool body 118. An internal bias unit 114 is coupled to the rotatable shaft 110 and positioned within the tool body 118. The rotatable shaft 110 is coupled to a drill bit 116 at its lower end and to a drill string 128 at its upper end. A near-bit stabilizer 120 is coupled to the rotatable shaft 110 upstream of the drill bit 116 and a string stabilizer 122 is coupled to the rotatable shaft 110 upstream of the tool body 118.

The rotary steerable drilling system 100 steers the drill bit 116 by engaging the borehole 10 at three touch points 117, 121 and 123. The first touch point 117 is located on the drill bit 116; the second touch 121 point is located on the near-bit stabilizer 120; and the third touch point 123 is located on the string stabilizer 122. In operation, the internal bias unit 114 exerts a force on the rotatable shaft 110 to deviate or point the drill bit 116 away from the longitudinal axis of the drill string 128 generally in the desired drilling direction. However, as compared to conventional systems, the stress and bending moment on the rotatable shaft 110 is reduced due to the pivotable feature 112, which allows articulation between an upper portion 111 of the rotatable shaft 110 and a lower portion 113 of the rotatable shaft 110 coupled to the drill bit 116. Due to this reduction, the required distance "L1" between the internal bias unit 114 and the next closest touch point toward the drill bit 116 (i.e. the second touch point 121 on the near-bit stabilizer 120) and the required distance "L2" between the internal bias unit 114 and the first touch point 117 on the drill bit 116 can be shortened for a given tilt angle over the distances "L1" and "L2" required for conventional systems without a pivotable feature. These shortened distances "L1" and "L2" tend to enable the rotary steerable drilling system 100 to achieve higher build rates over such conventional systems, including operation in high dogleg severity applications.

Although the shortened distances "L1" and "L2" have been described as factors that enable the rotary steerable system 100 to achieve higher build rates and operate in high dogleg severity applications, other factors may include: the tilt angle of the rotatable shaft 110 at the internal bias unit 114, the distance between the drill bit 116 and the internal bias unit 114, the distance between the near bit stabilizer 120 and the drill bit 116, the gauge of the near bit stabilizer 120, any deliberate offset/displacement of the near bit stabilizer 120, the distance between the string stabilizer 122 and the drill bit 116, the gauge of the string stabilizer 122, any deliberate offset/displacement of the string stabilizer 122, the anisotropy of the drill bit 116, the force capability of the internal bias unit 114, the extent of travel of the displacement output of the internal bias unit 114, mechanical flexibility of the rotary steerable system 100 due to gravity, bending and Weight-on-Bit (WOB), and other factors.

The pivotable feature 112 allows the drill bit 116 to be articulated to a greater tilt angle for a given lateral displacement of the internal bias unit 114 than would be feasible for a conventional rotatable shaft without a pivotable feature. In particular, the pivotable feature 112 reduces the cyclic bending fatigue exerted by the internal bias unit 114 on the rotatable shaft 110 as compared to the cyclic bending fatigue that would be exerted by the internal bias unit 114 on a conventional rotatable shaft to achieve the necessary offset for a high dogleg requirement. The pivotable feature 112 also enables the use of a rotatable shaft 110 that is stiffer and stronger in torsion and bending than would be desirable for a conventional rotatable shaft subject to bending by a bias unit without a pivotable feature. It will be appreciated that the upper portion 111 of the rotatable shaft 110 proximate the upper pivot structure 142 will still experience bending, such that the introduction of a second pivotable feature 112 to the upper portion 111 of the rotatable shaft 110 would further reduce the length of the substantially non-rotating tool body 118, enable the use of a stiffer and stronger rotatable shaft 110, and improve fatigue resistance.

In various embodiments, the pivotable feature 112 may comprise a universal (Cardan) joint, a constant-velocity joint, a knuckle joint, a spline joint, a dedicated flexible section, or any other component that enables articulation of the portions 111, 113 of the rotatable shaft 110 connected thereto. The pivotable feature 112 allows drilling fluid to be pumped therethrough. In some embodiments, the material forming the pivotable feature 112 may be different from the material forming the rotatable shaft 110. In an embodiment, the pivotable feature 112 comprises a high load carrying universal joint presented in a compact and simple configuration, such as the various embodiments of high load carrying universal joints disclosed in U.S. patent application Ser. No. 13/699,615, filed Jun. 17, 2012, and entitled "High Load Universal Joint for Downhole Rotary Steerable Drilling Tool," now abandoned, hereby incorporated herein by reference for all purposes.

During operation of the rotary steerable drilling system 100, the upper pivot structure 142 and/or the lower pivot structure 144 function to support the axial load applied to the rotatable shaft 110 from the drill string 128 (Weight-on-Bit transfer) while enabling pivoting/tilting/articulation between the rotatable shaft 110 and the tool body 118 as the drilling system 100 steers the drill bit 116. In various embodiments, the pivot structures 142, 144 may comprise radial bearings, such as, for example, roller bearings or balls bearings; thrust bearings, such as, for example, Mitchell-type thrust bearings, ball thrust bearings, roller thrust bearings, fluid bearings, or magnetic bearings; self-aligning roller thrust bearings; Wingquist bearings, which are self-aligning ball bearings, or any other type of structure that enables the rotatable shaft 110 to be pivoted/tilted/articulated with respect to the tool body 118 without undue torsional friction therebetween and while supporting the axial load.

In various embodiments, the pivot structures 142, 144 may be lubricated by the drilling fluid/mud that passes through the rotary steerable drilling system 100 during operation as it steers the drill bit 116, or by a dedicated lubrication fluid, such as hydraulic oil, for example, provided within a sealed enclosure(s) around the pivot structures 142, 144. Rotary seals, such as Kalsi seals, may be provided to seal the oil-filled enclosure and thereby inhibit the entry of drilling fluid and wellbore solids into the enclosure. Although several specific examples have been described, the present disclosure is not limited to any particular type of lubrication fluid or method of lubricating the pivot structures 142, 144. Moreover, while the drilling fluid has been described as drilling mud, the present disclosure is not limited to any particular type of drilling fluid or drilling method. Instead, the present disclosure is equally applicable to air drilling, foam drilling and drilling methods using other types of drilling fluids.

Figure 2A:
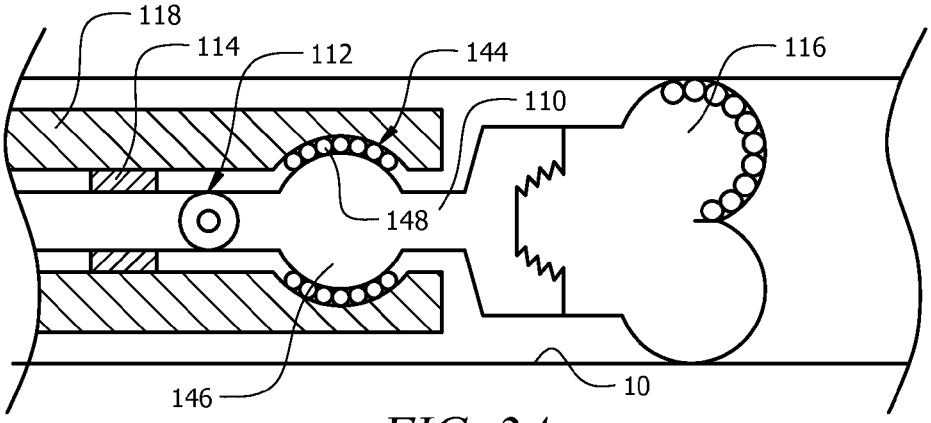
FIGS. 2A to 2C illustrate various embodiments of pivot structures that may support a rotatable shaft within a substantially non-rotating tool body, according to one or more aspects of the present disclosure.
Figure 2B:
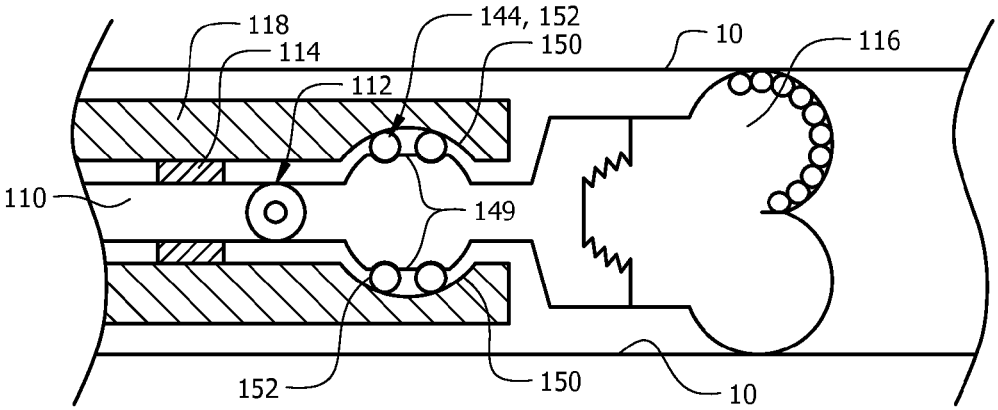
Figure 2C:
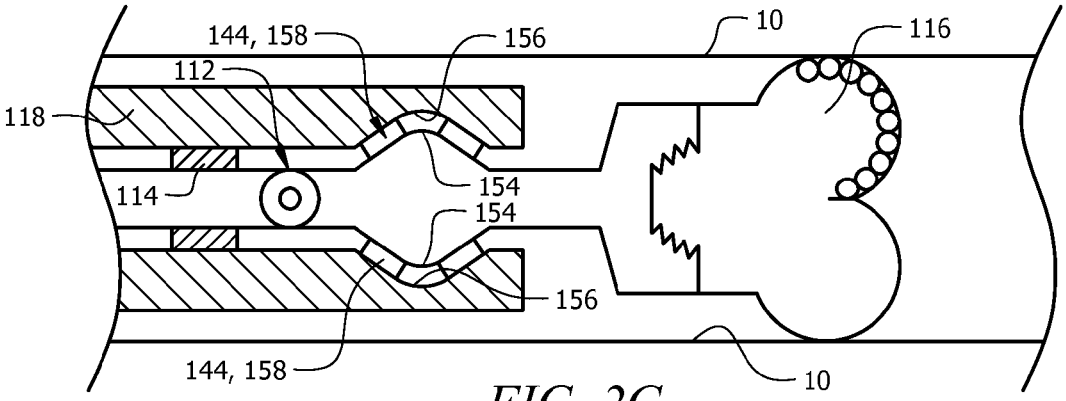

In various embodiments, the rotatable shaft 110 and/or the tool body 118 may comprise alternate shapes to accommodate different types of pivot structures 142, 144. FIGS. 2A to 2C illustrate expanded views of different examples of lower pivot structures 144 and associated alternate embodiments of the rotatable shaft 110 and tool body 118. However, these examples are identified for understanding and clarity only, and the present disclosure is not limited to any particular type of pivot structure 142, 144 or method of pivoting the rotatable shaft 110 with respect to the tool body 118.

Referring now to FIG. 2A, in some embodiments, the rotatable shaft 110 may comprise a rounded portion 146 that interacts with a rounded recess 148 in the tool body 118 to form a ball pivot configuration(s). A similar ball pivot configuration or a different type of pivot configuration may be provided between the rotatable shaft 110 and tool body 118 around the upper pivot structure 142. In the ball pivot configuration depicted in FIG. 2A, the rounded portion 146 of the rotatable shaft 110 is supported in the recess 148 of the tool body 118 by a pivot structure 144 that may comprise roller or ball bearings. A thrust bearing (not shown) may optionally be provided between the ball pivot configuration and the drill bit 116 to support the axial load on the rotatable shaft 110.

Referring now to FIG. 2B, in some embodiments, the rotatable shaft 110 may comprise a substantially straight portion 149, the tool body 118 may comprise a curved recess 150, and the lower pivot structure 144 may comprise a Wingquist bearing 152 (self-aligning ball bearings). A similar configuration or a different configuration may be provided between the rotatable shaft 110 and tool body 118 around the upper pivot structure 142. In the configuration shown in FIG. 2B, the pivot structure 144/Wingquist bearing 152 is disposed in the curved recess 150 of the tool body 118 and interacts with the substantially straight portion 149 of the rotatable shaft 110 to enable tilting/pivoting/articulating of the rotatable shaft 110 with respect to the tool body 118.

Referring now to FIG. 2C, in some embodiments, the rotatable shaft 110 may comprise a substantially tapered surface 154, the tool body 118 may comprise a substantially tapered surface 156, and the lower pivot structure 144 may comprise a self-aligning roller thrust bearing 158. A similar configuration or a different configuration may be provided between the rotatable shaft 110 and tool body 118 around the upper pivot structure 142. In the configuration shown in FIG. 2C, the pivot structure 144/self-aligning roller thrust bearing 158 is disposed between the substantially tapered surfaces 154, 156 to enable tilting/pivoting/articulating of the rotatable shaft 110 with respect to the tool body 118.

Figure 3A:
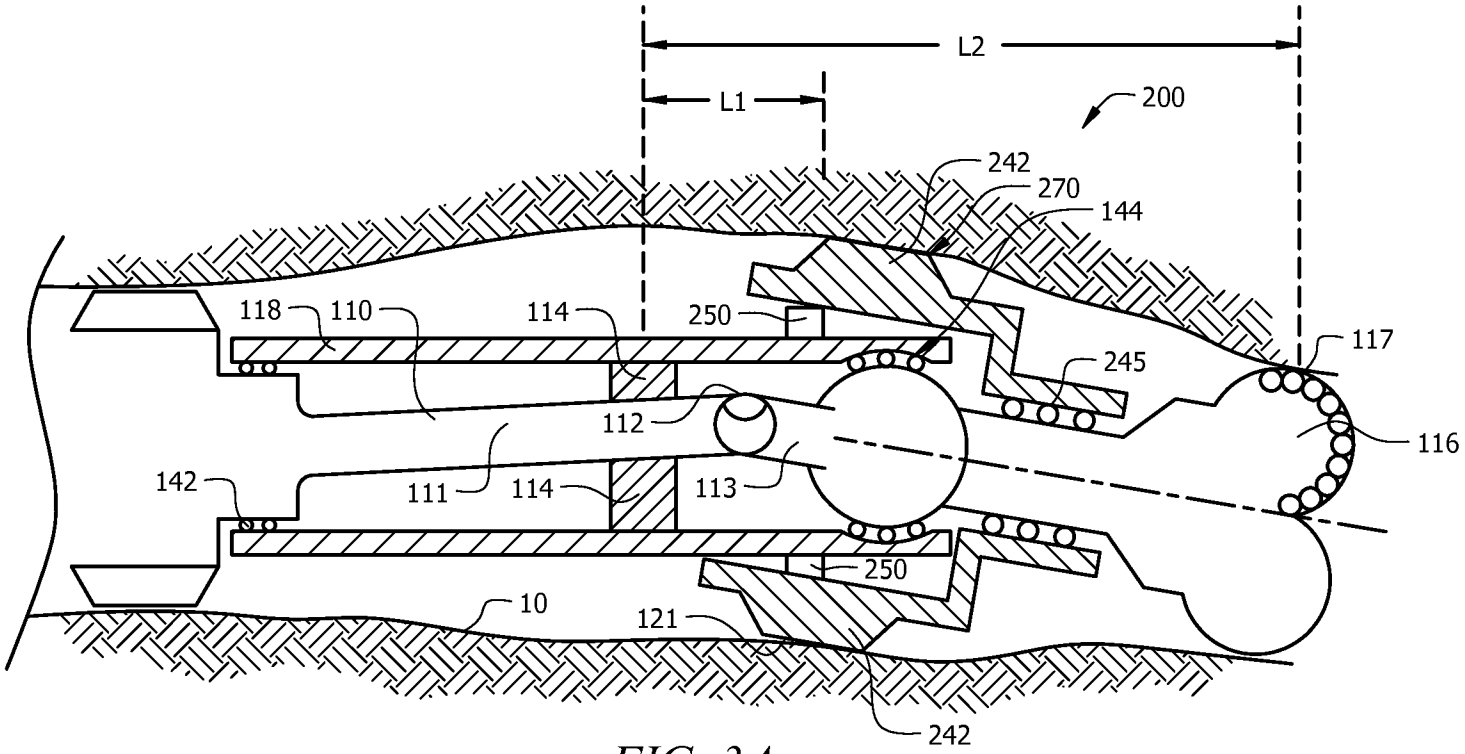
FIGS. 3A and 3B illustrate various hybrid rotary steerable drilling systems having a substantially non-rotating tool body, a rotatable shaft with a pivotable feature, an internal bias unit, and at least one force application member, according to one or more aspects of the present disclosure.
Figure 3B:
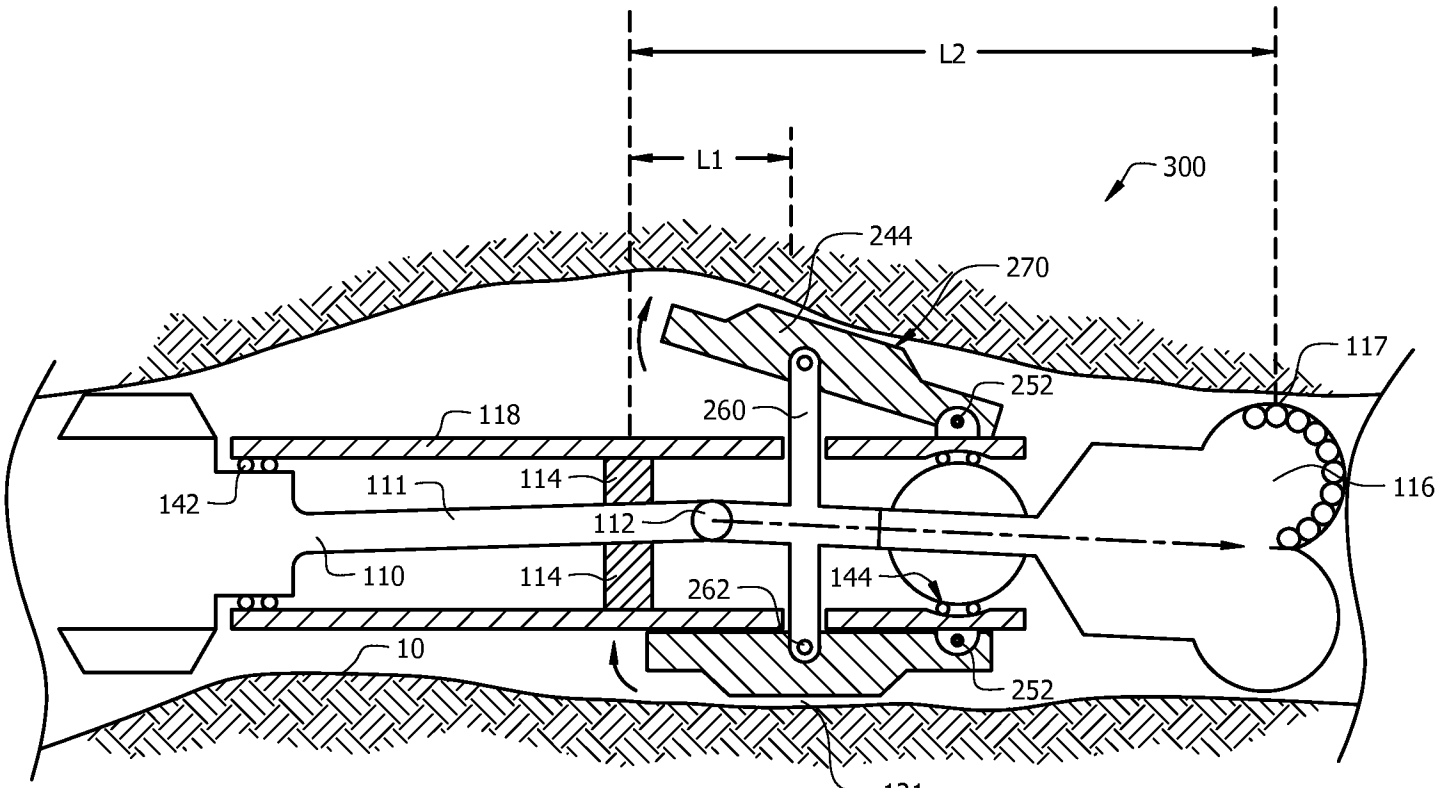

Referring now to FIGS. 3A and 3B, embodiments of hybrid rotary steerable drilling systems 200, 300 are shown disposed within a wellbore 10. As previously described, a hybrid rotary steerable drilling system combines the structure and functionality of both the classical point-the-bit system and the classical push-the-bit system into a single system by design. The hybrid rotary steerable drilling systems 200, 300 share several features in common with the drilling system 100 of FIG. 1, and like reference numerals denote like components. The point-the-bit aspects of the hybrid drilling systems 200, 300 comprise a rotatable shaft 110 with a pivotable feature 112, one or more of the upper and lower pivot structures 142, 144, an internal bias unit 114 and a substantially non-rotating tool body 118. However, in hybrid drilling systems 200, 300 the high dogleg steering response is achieved by combining two effects—pointing and displacing the drill bit 116 via the lower pivot structure 144 and a further lateral displacement of the drill bit 116 due to articulation of a steering sleeve 242 at touch point 121. As a result, the required distance "L1" between the internal bias unit 114 and the second touch point 121, and the required distance "L2" between the internal bias unit 114 and the first touch point 117 on the drill bit 116 can be even shorter than the distances "L1" and "L2" required by drilling system 100. These shortened distances "L1" and "L2" in combination with an increased tilt angle (and other factors) tend to enable the hybrid drilling system 200 to achieve even higher build rates than the drilling system 100 of FIG. 1, including operation in higher dogleg severity applications.

The hybrid drilling systems 200, 300 further comprise push-the-bit features, namely, a lateral displacement or force application member 270 axially coupled to the lower portion 113 of the rotatable shaft 110 and the drill bit 116, substantially non-rotating with respect to the well bore 10, and either rotationally free or rotatably coupled to the substantially non-rotating tool body 118, in alternative configurations. The force application member 270 of the hybrid drilling system 200 of FIG. 3A comprises a steering sleeve 242, and the force application member 270 of the hybrid drilling system 300 of FIG. 3B comprises a plurality of steering ribs 244 coupled to a yoke 260. In various embodiments, the steering sleeve 242 and/or the steering ribs 244 may be fixed components or they may be dynamically controlled.

Referring now to FIG. 3A, the steering sleeve 242 is coupled to the non-rotating tool body 118 via a stop (or dog) 250 to prevent the steering sleeve 242 from rotating within the well bore 10. A pivot structure 245 is provided between the steering sleeve 242 and the drill bit 116 to allow the steering sleeve 242 to pivot/tilt/articulate with the drill bit 116.

In the embodiment shown in FIG. 3A, the internal bias unit 114 may be operated to laterally displace the rotatable shaft 110 to achieve a tilting of the lower portion 113 of the rotatable shaft 110 about pivot structure 144, which in turn tilts and displaces the drill bit 116. Since the steering sleeve 242 is also coupled to the rotatable shaft 110/drill bit 116 via pivot structure 245, the steering sleeve 242 is also caused to tilt, and due to its touch point 121 being located uphole from pivot structure 144, the centerline of the substantially non-rotating tool body 118 is further laterally displaced in a direction that adds to the dogleg effect achieved by tilting the drill bit 116.

In another configuration, the internal bias unit 114 may be eliminated from the hybrid drilling system 200 of FIG. 3A, and stops (or dogs) 250 may be used to displace the steering sleeve 242, which in turn will cause the rotatable shaft 110 to deflect about the pivotable feature 112. In this configuration, the steering sleeve 242 may be rotatably coupled the substantially non-rotating tool body 118.

Referring now to FIG. 3B, the steering ribs 244 are pivotably coupled at 252 to the tool body 118 and at 262 to a yoke 260 having a plurality of arms, such as four arms. In an embodiment, a steering rib 244 is pivotably coupled at 262 to each arm of the yoke 260. The yoke 260 is rotatably coupled (i.e. the drive shaft passes through the yoke 260) to the rotatable shaft 110 below the pivotable feature 112 and extends through the tool body 118. As the bias unit 114 and the pivotable feature 112 articulate the rotatable shaft 110, the yoke 260 is likewise articulated, which thereby causes the plurality of steering ribs 244 to extend outwardly or contract inwardly as dictated by the geometrical constraints.

In operation, the steering sleeve 142 of system 200 or the steering ribs 244 of system 300 exert force against the wall of the borehole 10 to direct the hybrid drilling system 200, 300 in the desired direction of drilling. Thus, the hybrid drilling systems 200, 300 of FIGS. 3A and 3B combine both point-the-bit and push-the-bit steering principles to further increase build rate and high dogleg severity capacity. In particular, by using both the internal bias unit 114 to tilt the drill bit 116 and the external force application member 270 (i.e. the steering sleeve 242 or the steering ribs 244) to laterally displace the tool body 118, a hybrid point and push steering system is achieved, resulting in a higher tilt angle of the drill bit 116.

Figure 4B:
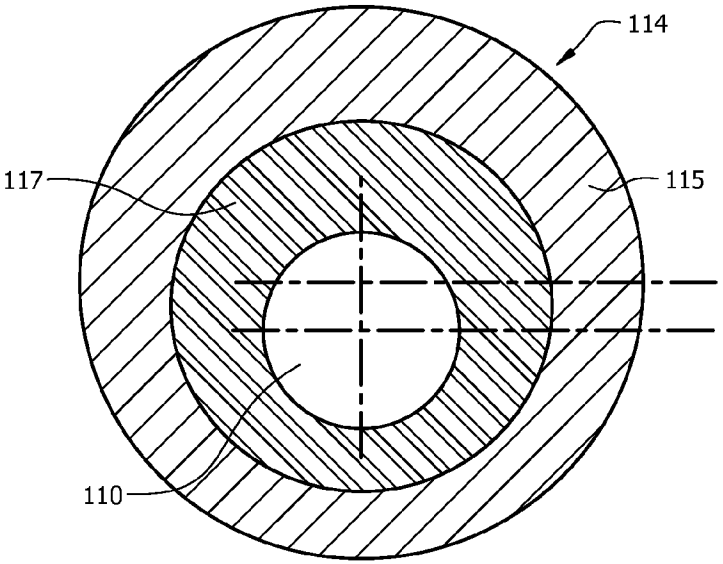
FIGS. 4A and 4B illustrate cross-sectional views of an internal bias unit comprising two eccentric rings, depicting the internal bias unit positioning a rotatable shaft in a centered position and an eccentric position, respectively, according to one or more aspects of the present disclosure.
Figure 4A:
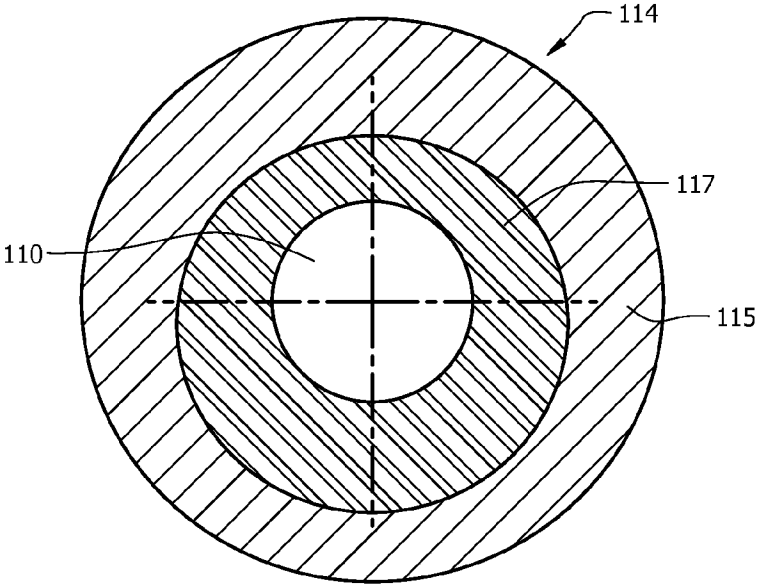

Referring now to FIGS. 4A and 4B, cross-sectional end views are illustrated of an embodiment of an internal bias unit 114 in various operational positions. This embodiment of internal bias unit 114 comprises an internal ring 117 with an eccentric hole through which the rotatable shaft 110 extends, and an external ring 115 with an eccentric hole surrounding the internal ring 117. As the external ring 115 is rotated with respect to the internal ring 117, an eccentric motion is transmitted to the internal ring 117, causing the internal ring 117 to rotate with respect to the rotatable shaft 110. An eccentric motion is thereby transmitted to the rotatable shaft 110, altering the position of the rotatable shaft 110 within the tool body 118.

FIG. 4A depicts the internal bias unit 114 with the rings 115, 117 oriented to substantially center the rotatable shaft 110 within the tool body 118, and FIG. 4B depicts the internal bias unit 114 with the rings 115, 117 oriented to substantially eccenter the rotatable shaft 110 within a lower portion of the tool body 118. It will be appreciated that the rotary steerable drilling systems of the present disclosure is not limited to the use of any specific type of internal bias unit.

Figure 5:
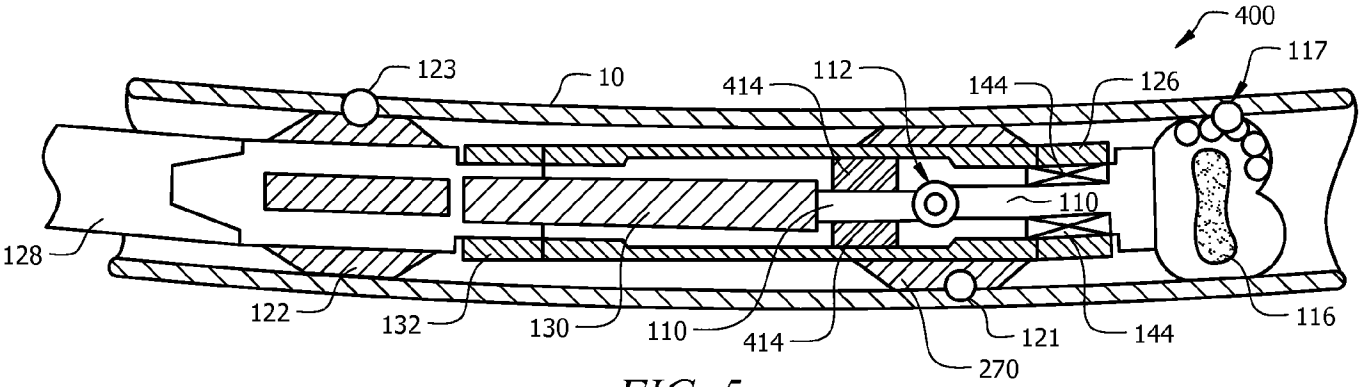
FIG. 5 is an illustration of a downhole steerable motor, according to one or more aspects of the present disclosure.

Referring now to FIG. 5, in another aspect, the present disclosure may comprise a downhole steerable motor 400 having a rotor 130 coupled to a rotatable shaft 110 with a pivotable feature 112, a motor housing 132 (a stator) deployed around both the rotor 130 and the rotatable shaft 110, a pivot structure 144 supporting the rotatable shaft 110 within the motor housing 132 or a near-bit sleeve stabilizer 126 coupled to the motor housing 132, and a dynamically adjustable bias unit 414 within the motor housing 132 and coupled to the rotatable shaft 110 near the pivotable feature 112. In an embodiment, the downhole steerable motor 400 does not have a substantially non-rotating motor housing 132, in contrast to the rotary downhole steering systems 100, 200, 300 of FIGS. 1 through 3B. In an embodiment, the downhole steerable motor 400 is rotated slowly within the well bore 10 to substantially eliminate differential sticking without undue wear. Further, in an embodiment, the power section (rotor 130 and stator 132) are operable to rotate the drill bit 116 at higher revolutions per minute to increases the rate of penetration during drilling.

Drilling fluid/mud generally flows between the rotor 130 and motor housing 132, but in various embodiments, the pivot structure 144 may be lubricated by the drilling fluid/mud that passes through the rotary steerable drilling system 400 during operation as it steers the drill bit 116, or by a dedicated hydraulic fluid, such as gear oil, for example, provided within a sealed enclosure around the pivot structure 144. Rotary seals, such as Kalsi seals, may be provided to seal the oil-filled enclosure and thereby inhibit the entry of drilling fluid and wellbore solids into the enclosure. Although several specific examples have been described, the present disclosure is not limited to any particular type of lubrication fluid or method of lubricating the pivot structure 144.

In an embodiment, the dynamically adjustable bias unit 414 comprises a plurality of circumferentially disposed pistons placed around the bias unit 414 to enable dynamic adjustment of the rotatable shaft 110 within the motor housing 132. In an embodiment, drilling fluid ported from above the motor housing 132 is used to actuate the dynamically adjustable bias unit 414. Thus, the differential pressure drop of the drilling fluid across the motor is used to power the bias unit 414. The downhole steerable motor 400 of FIG. 5 may further comprise at least one force application member 270 coupled to the motor housing 132 near the drill bit 116 (i.e. as shown in FIGS. 3A and 3B). In an embodiment, the primary actuation mechanism (not shown) for the bias unit 414 may also be the primary actuation mechanism for the at least one force application member 270—thereby permitting the same actuation mechanism to both point the drill bit 116 via the bias unit 414 and push the drill bit 116 via the at least one force application member 270 (as shown in FIGS. 3A and 3B).

In operation, the downhole steerable motor 400 may advance the drill bit 116 by rotating, while the tool face (the direction the motor 400 is steering the drill bit 116) and the build rate may be substantially continuously dynamically adjusted via the bias unit 414. According to some embodiments of the present disclosure, such dynamic adjustment of the bias unit 414 enables the tool face to be held substantially continuously in a rotary drilling mode.

Thus, the downhole steerable motor 400 of FIG. 5 combines both point-the-bit and push-the-bit steering principles to further increase build rate and high dogleg severity capacity. In particular, by using both the internal bias unit 414 and the external force application member 270, a higher tilt angle of the drill bit 116 can be achieved though the rotatable shaft 110 with the pivotable feature 112. Employing a dynamically adjustable bias unit 414 enables rotary steerable drilling with a power section (integrated mud motor 400).

Figure 6A:
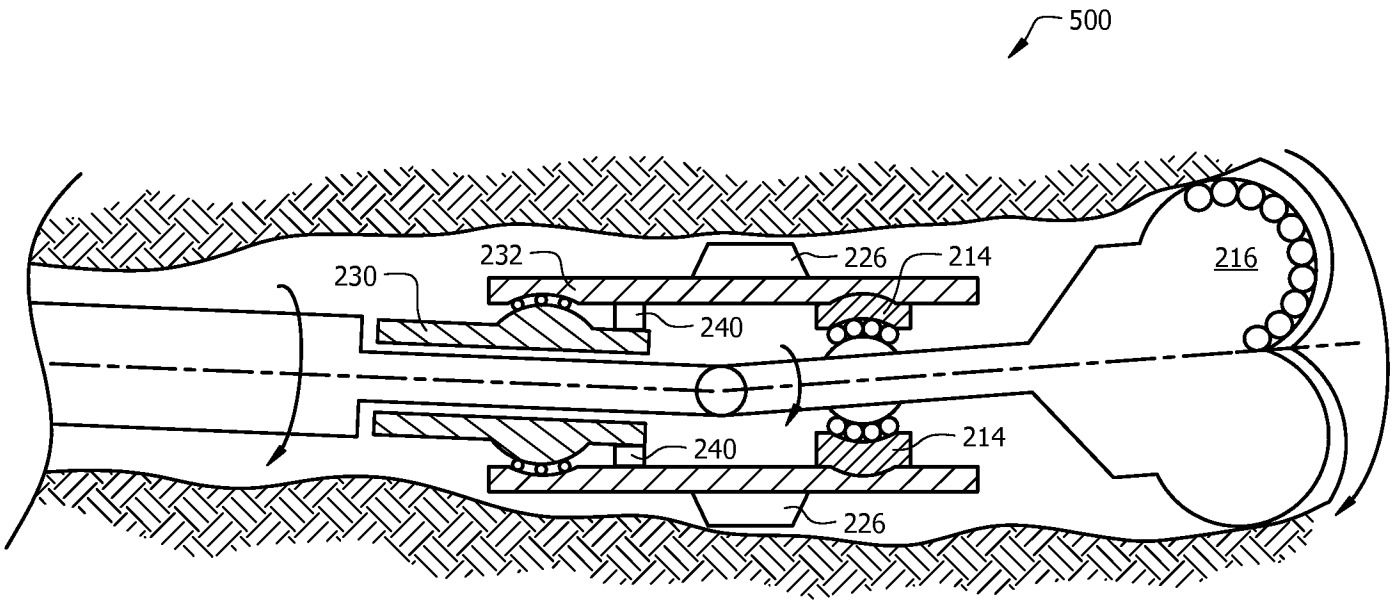
FIGS. 6A and 6B illustrate various hybrid rotary steerable drilling systems having two substantially non-rotating tool bodies, a rotatable shaft with a pivotable feature, an internal bias unit, and at least one force application member, according to one or more aspects of the present disclosure.
Figure 6B:
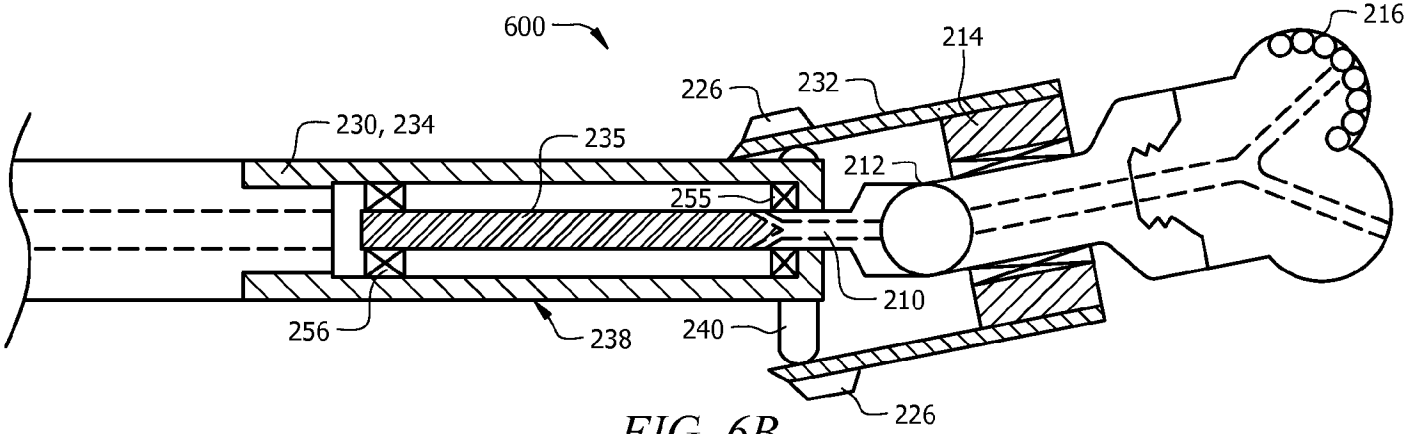

Referring now to FIGS. 6A and 6B, embodiments of hybrid drilling systems 500, 600 are illustrated that comprise first and second substantially non-rotatable tool bodies (230 and 232) pivotally connected together, a rotatable shaft 210 including a pivotable feature 212 disposed within the second tool body 232, an internal bias member 214 coupled to the rotatable shaft 210, and at least one force application member 240 disposed to displace/tilt the second tool body 232 with respect to the first tool body 230. A drill bit 216 is coupled to a near-bit sleeve stabilizer 226, which is coupled to the rotatable shaft 210.

In this configuration, the internal bias member 214 operates to tilt or point the drill bit 216 in the desired drilling direction by altering the lateral position of the rotatable shaft 210 within the second substantially non-rotatable tool body 232. The at least one force application member 240 operates to tilt/displace the second tool body 232 with respect to the first tool body 230 and thereby push the drill bit 216 in the desired direction of drilling. Thus, the hybrid drilling systems 500, 600 of FIGS. 6A and 6B combine both point-the-bit and push-the-bit steering principles to further increase build rate and high dogleg severity capacity.

In the embodiment shown in FIG. 6A, the hybrid drilling system 500 is a rotary steerable system. In the embodiment shown in FIG. 6B, the hybrid drilling system 600 comprises a downhole motor 238 that rotationally drives the drill bit 216. In such a hybrid drilling system 600, the first non-rotating/slowly-rotating tool body 230 may comprise a stator 234 of the downhole motor 238, which supports a rotor 235 of the downhole motor 238 therein via lower bearings 255 and upper bearings 256. The upper bearings 256 may be optional. In this embodiment, the at least one force application member 240 is coupled to the stator 234 of the downhole motor 238.

In another embodiment of the hybrid rotary steerable drilling system 500, 600 of FIGS. 6A and 6B, the second tool body 232 may be rotatable. For example, the rotatable second tool body 232 may be coupled to the drill bit 216 and rotate therewith. In such a configuration, the internal bias unit 214 still enables tilting or pointing the drill bit 216 by synchronously modulating or altering the position of the rotatable shaft 210 with the pivotable feature 212 with respect to the second rotatable tool body 232 (close to the bit 216) in phase with the rotation of the bit.

Figure 7:
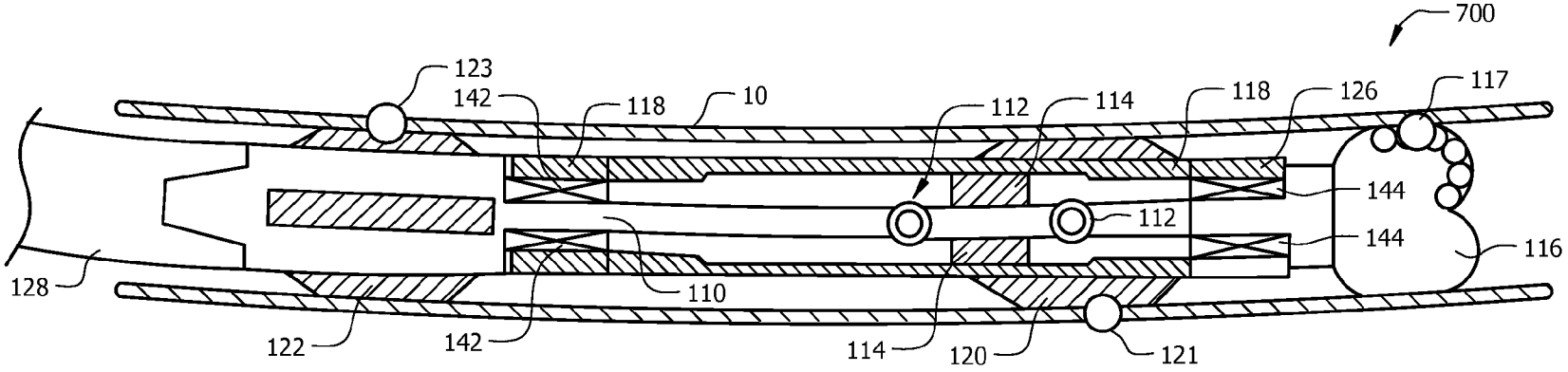
FIG. 7 is an illustration of another hybrid rotary steerable drilling system having a substantially non-rotating tool body, a rotatable shaft with a plurality of pivotable features, and an internal bias unit, according to one or more aspects of the present disclosure.

Turning now to FIG. 7, an embodiment of a hybrid rotary steerable drilling system 700 is illustrated that is substantially similar to the hybrid rotary steerable drilling systems 200, 300 depicted in FIGS. 3A and 3B, except the drilling system 700 of FIG. 7 comprises two pivotable feature 112 provided on the rotatable shaft 110 above and below the bias unit 114, respectively. Such a configuration may enhance the point-the-bit and push-the-bit capabilities of the drilling system 600 and may be applied to both steerable tools and steerable motor applications. As previously discussed, the pivotable features 112 may comprise universal joints, a constant-velocity joints, knuckle joints, spline joints, flexible sections, and combinations thereof.

In accordance with one aspect of the present disclosure, a rotary steerable drilling system is provided that includes a substantially non-rotating tool body, a rotatable shaft including at least one pivotable feature, the rotatable shaft at least partially disposed within the tool body, and a bias unit that alters the position of the rotatable shaft within the tool body. In various embodiments, pivotable joints may be selected from a group consisting of a universal joint, a constant-velocity joint, a knuckle joint, a spline joint, and a flexible section.

In accordance with another aspect of the present disclosure, a rotary steerable drilling system is provided that includes a substantially non-rotating tool body, a rotatable shaft including at least one pivotable feature, a bias unit that alters the position of the rotatable shaft within the tool body, and at least one force application member that alters the position of the tool body in a borehole.

In accordance with yet another embodiment of the present disclosure, a downhole steering motor is provided that includes a rotor shaft including at least one pivotable joint, a steering motor housing, a bias unit that alters the position of the rotor shaft inside the steering motor housing, and at least one force application member that alters the position of the steering motor housing in a borehole.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A rotary steerable drilling system comprising:

a substantially non-rotating tool body;

a rotatable shaft including a first pivotable feature and a second pivotable feature, the rotatable shaft at least partially disposed within the tool body, the rotatable shaft including an upper portion and a lower portion, the lower portion configured for coupling to a drill bit, the first pivotable feature coupled between the upper portion and the lower portion within the tool body, the second pivotable feature coupled to the upper portion within the tool body; and a bias unit that alters the position of the rotatable shaft within the tool body, the bias unit disposed within the tool body and coupled to the rotatable shaft between the first pivotable feature and the upper portion of the rotatable shaft.

2. The rotary steerable drilling system of claim 1, wherein at least one of the first pivotable feature and the second pivotable feature is selected from a group consisting of: a universal joint, a constant-velocity joint, a knuckle joint, a spline joint, and a flexible section.

3. The rotary steerable drilling system of claim 1, wherein at least one of the first pivotable feature and the second pivotable feature comprises an internal passage to conduct flowing drilling fluid.

4. The rotary steerable drilling system of claim 1, wherein the bias unit comprises a plurality of eccentric rings disposed around the rotatable shaft.

5. The rotary steerable drilling system of claim 1, wherein the bias unit is dynamically adjustable.

6. The rotary steerable drilling system of claim 5, where the bias unit is dynamically adjustable via a plurality of pistons circumferentially placed around the bias unit.

7. The rotary steerable drilling system of claim 1, further comprising at least one pivot structure disposed between the tool body and the rotatable shaft.

8. The rotary steerable drilling system of claim 7, wherein the at least one pivot structure is selected from a group consisting of: a radial bearing, a thrust bearing, a self-aligning radial bearing, and a self-aligning thrust bearing.

* * * * *